US005491877A

United States Patent [19]

Leifeld

[11] Patent Number: 5,491,877

[45] Date of Patent: Feb. 20, 1996

[54] APPARATUS FOR VERTICALLY DISPLACING A SHIFTABLE BOTTOM OF A COILER CAN

[75] Inventor: Ferdinand Leifeld, Kempen, Germany

[73] Assignee: Trützschler GmbH & Co. KG, Mönchengladbach, Germany

[21] Appl. No.: 401,907

[22] Filed: Mar. 10, 1995

Related U.S. Application Data

[63] Continuation of Ser. No. 242,094, May 13, 1994.

[30] Foreign Application Priority Data

May 14, 1993 [DE] Germany ..... 43 167 156.1
Mar. 9, 1994 [DE] Germany ..... 44 07 849.8

[51] Int. Cl.[6] ..... D04H 11/00

[52] U.S. Cl. ..... 19/159 A; 19/159 R; 242/363

[58] Field of Search ..... 19/159 R, 159 A; 242/361.3, 361.4, 361.5, 363

[56] References Cited

U.S. PATENT DOCUMENTS

| | | | |
|---|---|---|---|
| 2,018,261 | 10/1935 | Holdsworth | 19/159 |
| 3,088,690 | 5/1963 | Haugwitz | 242/361.5 |
| 4,437,620 | 3/1984 | Ozawa | 242/363 |
| 4,709,452 | 12/1987 | Cooley et al. | 19/159 R |
| 5,237,726 | 8/1993 | Gartenmann et al. | 19/159 R |

FOREIGN PATENT DOCUMENTS

| | | | |
|---|---|---|---|
| 344484 | 12/1989 | European Pat. Off. . | |
| 493341 | 7/1992 | European Pat. Off. . | |
| 14869 | 11/1880 | Germany | 19/159 R |
| 551223 | 5/1932 | Germany | 19/159 R |
| 1953988 | 2/1971 | Germany . | |
| 3621794 | 1/1988 | Germany . | |
| 426569 | 6/1967 | Switzerland . | |
| 1270832 | 4/1972 | United Kingdom . | |
| 2048321 | 12/1980 | United Kingdom . | |

*Primary Examiner*—John J. Calvert
*Attorney, Agent, or Firm*—Spencer & Frank

[57] ABSTRACT

A system for handling sliver produced by a fiber processing machine includes a sliver coiler head forming part of the fiber processing machine; and a coiler can supported in a substantially upright position under the coiler head for receiving sliver therefrom. The coiler can has a vertical wall and a can bottom surrounded by the vertical wall and being vertically displaceable relative to the wall. The system further has a can bottom shifting apparatus disposed externally of the coiler can and facing the vertical wall. The apparatus includes a carrier arrangement for at least indirectly engaging the can bottom for vertically shifting the can bottom.

3 Claims, 10 Drawing Sheets

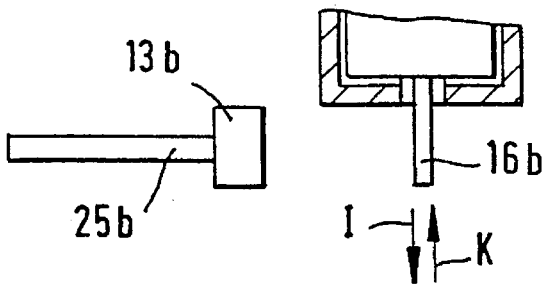
FIG. 8a
FIG. 8
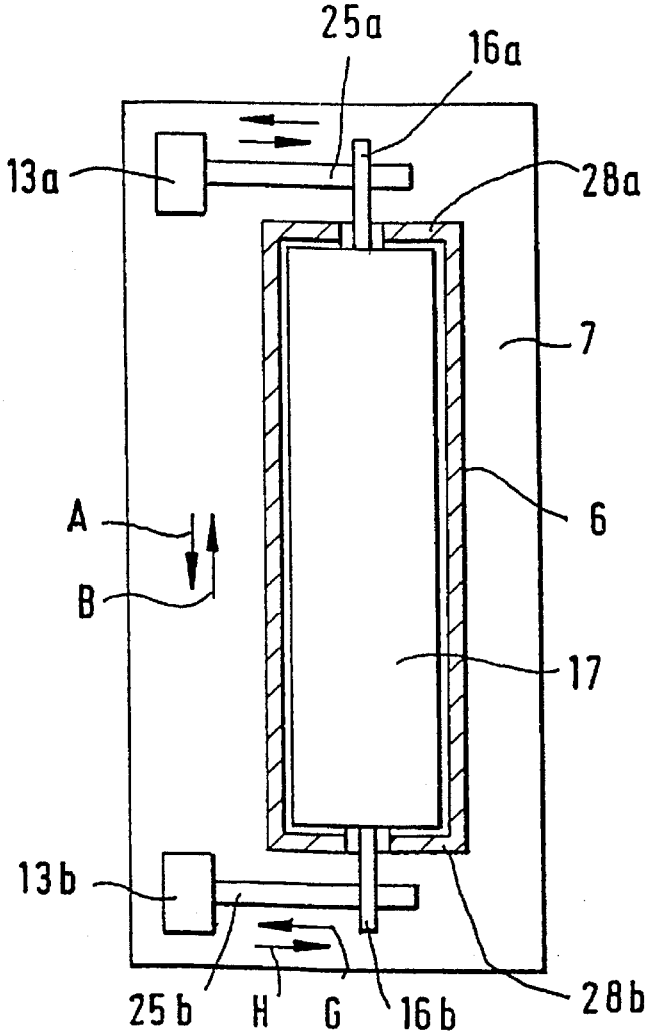

APPARATUS FOR VERTICALLY DISPLACING A SHIFTABLE BOTTOM OF A COILER CAN

This is a Continuation of application Ser. No. 08/242,094 filed May 13, 1994.

CROSS REFERENCE TO RELATED APPLICATION

This application claims the priority of German Applications No. P 43 16 156.1 filed May 14, 1993 and P 44 07 849.8 filed Mar. 9, 1994, which are incorporated herein by reference.

BACKGROUND OF THE INVENTION

This invention relates to a system for handling sliver produced by a fiber processing machine. The sliver formed of cotton, chemical fibers or the like is discharged by a coiler head of the sliver producing machine and deposited in coils in a coiler can which has a height-adjustable bottom. The invention particularly concerns an apparatus for shifting the can bottom.

In a conventional device the can bottom is positioned on a plate which is supported on a lazy tongs mechanism. The lower arms of the mechanism are connected with gears which mesh with a worm shaft. The worm shaft is rotated by a motor with the intermediary of a bevel gear. The lifting device is mounted on a displaceably supported carriage which is situated underneath the can. The carriage has on both sides horizontally oriented guide rollers which run in guide tracks. It is a disadvantage of such a prior art construction that additional space is required underneath the coiler can for the carriage and the lazy tongs mechanism. Also, such arrangement is structurally complex and expensive. It is of particular drawback that an additional carriage is needed for the lazy tongs mechanism. Also, the lifting of the can bottom is not sufficiently rapid.

SUMMARY OF THE INVENTION

It is an object of the invention to provide a system of the above-outlined type which eliminates the discussed disadvantages and which, in particular, is structurally simple and needs little space and furthermore permits a rapid and stable vertical displacement of the can bottom.

This object and others to become apparent as the specification progresses, are accomplished by the invention, according to which, briefly stated, the system for handling sliver produced by a fiber processing machine includes a sliver coiler head forming part of the fiber processing machine; and a coiler can supported in a substantially upright position under the coiler head for receiving sliver therefrom. The coiler can has a vertical wall and a can bottom surrounded by the vertical wall and being vertically displaceable relative to the wall. The system further has a can bottom shifting apparatus disposed externally of the coiler can and facing the vertical wall. The apparatus includes a carrier arrangement for at least indirectly engaging the can bottom for vertically shifting the can bottom.

By disposing the bottom-shifting device next to the external wall faces of the can, the space underneath the coiler head may be advantageously utilized for the can. Thus, the invention eliminates the spatial requirement for a bottom-shifting device underneath the can and consequently, by practicing the invention, a larger can with greater volume may be utilized. It is a further advantage that, as a departure from the known can bottom-shifting device, no structural components of the bottom-shifting device extend into the space surrounded by the can walls underneath the can bottom. The construction according to the invention thus provides for a significant structural simplification. By arranging the carrier elements externally of the can, a rapid displacement of the can bottom from a lower position to a higher position is possible. The carrier elements may be simply and rapidly coupled to and uncoupled from the can bottom and may effect an even, horizontal lifting and lowering of the can bottom in a stable position.

According to an advantageous feature of the invention, the lifting device is associated with the can emplacement situated ahead of the sliver charging station, for example, a standby emplacement or an empty-can storage device. Such an embodiment saves significant time during can exchange because the bottom of the can, prior to its reaching of the charging station, has already been moved into its upper position. The invention thus provides for a separation of the lifting and lowering functions of the bottom-shifting device. On the can emplacement, ahead of the charging station, the can bottom is thus shifted into its upper position and the can reaches the charging station while the can bottom is held in its upper position by stop means.

While in the earlier-outlined embodiment for the charging station and the adjacent can emplacement separate bottom-raising and bottom-lowering devices are required, according to an advantageous embodiment of the invention a single, combined raising and lowering device is installed in the sliver charging station. In this embodiment, the can is supplied to the charging station with the bottom in the low position so that it is expedient to drive the device in the lifting direction with a greater speed than in the lowering direction.

According to a further advantageous feature of the invention, the carrier elements project through vertical openings such as slots, provided in the can walls. Advantageously, at the can bottom engagement elements are provided which have a supporting surface. By virtue of the fact that the engagement elements project laterally from the can walls, the can bottom-shifting device may be of very simple construction. The arrangement of the engagement elements virtually enlarges the can bottom surface, so that the can bottom may be easily maintained in a horizontal orientation, because it is held at its outermost zones by the carrier elements. It is thus possible to operate with larger tolerances without the risk that the can bottom assumes an undesirable, oblique orientation.

According to a further advantageous feature of the invention, the can bottom-shifting device includes a vertical flexible transporting element, for example, a belt, a band, a toothed belt, a chain or the like for moving the carrier elements mounted thereon. The flexible transporting element is positioned by deflecting rollers. Expediently, one deflecting roller is coupled to a power device, such as an rpm-regulated motor. Such a deflecting roller thus functions as a driving element which directly raises or lowers the carrier elements mounted on the flexible transport element. The motor may run with different rpm's, that is, upon raising the carrier elements and thus the can bottom, it runs with a high rpm, whereas a lowering of the can bottom is effected with a lower speed. According to a further feature of the invention, the can bottom-shifting device includes a driven threaded spindle on which there is mounted a threaded travelling nut affixed to the carrier element.

Preferably, the can has vertical slots provided in the can wall, and a reinforcement is effected by the angling or crimping the can wall in the zone of the slots. In addition to reinforcement, such an angling or crimping has the advantage that it rounds the slot edges, thus diminishing the friction between the can wall and the carrier elements and reducing the risk of injuries.

Expediently, the coiler can, while it is being charged with sliver, is movable back and forth underneath the stationarily supported coiler head of the sliver producing fiber processing machine, such as a drafting frame. As a further feature of the invention, the can bottom-shifting device is mounted on the sled of the can reciprocating unit.

Advantageously, two can bottom-shifting devices are provided. One of the devices is situated in the sliver charging station whereas the other is situated adjacent thereto. The shifting device in the sliver charging station has only the function to lower the can bottom whereas the device adjacent the charging station has only a bottom-raising function. By means of such function separation, it is feasible to operate with separate drive motors which is expedient as concerns time saving and simplification of control since the raising function should occur at high speed in order to place the can rapidly into an operative position, whereas the lowering operation is performed slower; it depends from the supply rate of the discharged sliver material.

According to a further advantageous feature of the invention, the drive for the vertical shifting device is a pressure cylinder and according to a further feature, the flexible transport element is a belt of predetermined length fixed at opposite ends. The cylinder is advantageously a double-acting cylinder; it is provided with a throughgoing piston rod which, at both ends, carries deflecting rollers for the flexible transport element. The pressure cylinder is expediently a pneumatic cylinder; it thus may be moved (raised) with high speed with simple pressure regulation in one direction and upon charging the other side of the piston with a lower pressure, it may be moved (lowered) in a gentle manner with low speed. The pressurized air in the cylinder may resiliently yield to the increasing weight of the sliver in the can and thus the can bottom may sink against such air pressure, rather than the conventional mechanical spring support for the can bottom. By the stationary disposition of the pressure cylinder in conjunction with the throughgoing piston rod and the deflecting rollers which are carried on both ends of the piston rod and about which the flexible transport element is trained, the piston needs to move only one half the path of the required displacement of the can bottom.

According to still another embodiment of the invention, the bottom-shifting device is arranged at the front (small) side of the flat can and the slots are provided in the small can faces. An association of the bottom-shifting device with the small side of the flat can makes possible a transverse introduction of the cans into the charging station, that is, an introduction parallel to the opposite small sides of the can. The provision of the slots in the small sides makes possible that the engagement elements affixed to the can bottom may project directly toward the carrier elements of the bottom-shifting device, so that the carrier elements of the bottom-shifting device need not be moved over the long sides of the flat can in order to arrive into operative contact with the engagement elements affixed to the can bottom.

In accordance with a particularly advantageous feature of the invention, the sliver producing fiber processing machine (such as a drafting frame), the sliver coiler drive, the can exchanging device and the bottom-shifting device are connected to a common electric control and regulating apparatus. By virtue of such a control, it is possible to coordinate the speeds and function of all the aggregates by means of a central computer.

According to a further advantageous feature of the invention, the coiler head of the sliver coiler continues to run with a reduced speed during the exchange of the cans. This embodiment has particular significance in using the invention in a drafting frame because it is possible to maintain the draft therein, since, in addition to the coiler head, the entire drafting frame continues to operate. Therefore, by avoiding a starting and stopping operation a more uniform sliver is produced.

Further advantageous features of the invention provide that between the carrier element at the bottom-shifting device and the engagement element affixed to the can bottom, a measuring element is positioned which is preferably a pressure or path measuring element. Expediently, between the carrier element and the engagement element a spring is provided which is connected parallel to the path measuring element. The latter is connected with the control for the height-adjustable carrier element or with the central control and regulating apparatus. By measuring the force and/or displacement, an accurate control of the lowering of the can bottom is possible as a function of the fill level in the can. By computer control the can bottom displacement may be controlled as a function of the measured force or other value. It is also possible to program-control the bottom path for different heights with different variables. According to a further feature of the invention, the filling weight of the can is subtracted so that only the pressing force is a measure for the feed. Advantageously, the height correction for the can bottoms may be effected automatically as a function of the signals from the position (displacement) sensor.

BRIEF DESCRIPTION OF THE DRAWINGS

FIG. 8 is a sectional top plan view of another preferred embodiment.

FIG. 8*a* is a fragmentary sectional top plan view of a part of the structure of FIG. 8, showing a different operational position.

DESCRIPTION OF THE PREFERRED EMBODIMENTS

Figure 1:
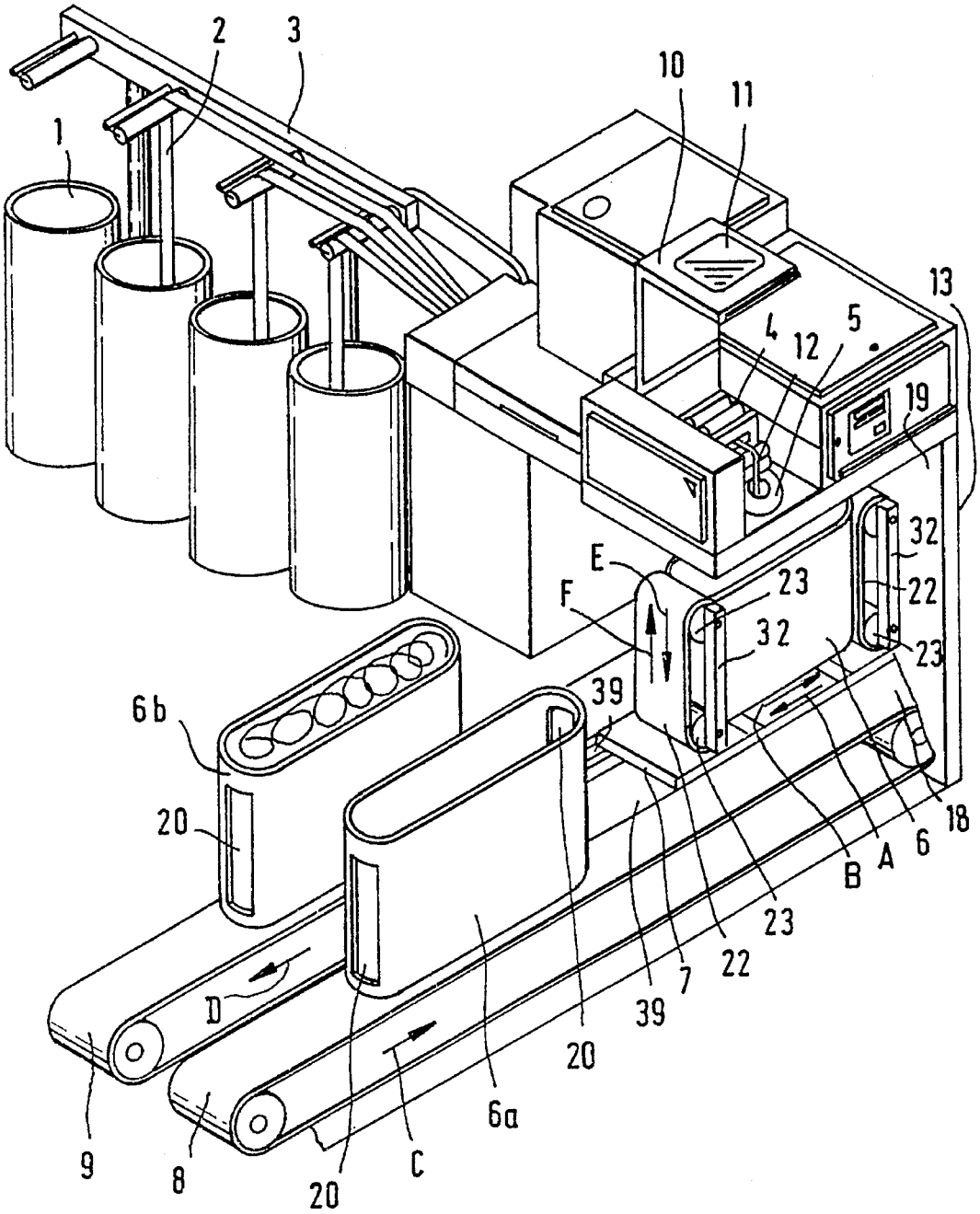
FIG. 1 is a schematic perspective view of a system including a drafting frame and a can bottom-shifting device according to the invention.

Turning to FIG. 1, there are illustrated cylindrical coiler cans 1 situated underneath a sliver intake station 3 of a drafting frame. Slivers 2 from a plurality of cans 1 are simultaneously introduced into the drafting frame and guided through the drafting unit 4 which produces a sliver 12 introduced into the coiler head 5 of the sliver coiler and discharges the sliver 12 in a flat can 6. The flat can 6 stands on a sled 7 which is moved horizontally back and forth as indicated by the arrows A and B by means of a nonillustrated reciprocating device. The drafting unit 4 and the coiler head 5 are protected by a cover 10 which is provided with a window 11 to observe the drafting and sliver depositing operations. Adjacent the charging station 19 immediately adjoining the sled 7 on either side thereof there are situated conveyor belts 8 and 9 for delivering empty cans **6*a* toward the charging station 19 in the direction of the arrow C and, respectively, full cans 6*b* from the charging station 19 in the direction of the arrow D. The horizontal length dimension of the cans supported on the belts 8 and 9 is parallel to the conveying direction C, D. With the aid of, for example, a non-illustrated can exchanging device, a full can 6*b* may be pushed off the sled 7 onto the input end of the conveyor belt 9 and at the same time, an empty can 6*a* is pushed from the output end of the conveyor belt 8 onto the sled 7**.

On the sled 7 a can bottom-shifting device 13 according to the invention is mounted which includes a stand 32 supporting flexible transport elements 22. Also referring to FIG. 2, the can bottom 17 has engagement elements 16 which, on opposite small sides of the flat can 6, project therefrom through vertical slots 20 provided in the small sides. To the flexible transport elements 22 respective carrier elements 25 are affixed on which there are positioned the engagement elements 16 of the can bottom 17. The transport element 22 is a chain supported by end sprockets 23. One of the end sprockets is driven by a motor 24 with the intermediary of a belt pulley 40 and a drive belt 38. The motor 24 is of the reversible type and thus may run with variable rpm's in either direction. The carrier elements 25 and the engagement elements 16, upon arrival of an empty can **6*a* on the sled 7, assume a vertically superposed relationship, so that an upward displacement of the carrier elements 25 will cause an upward shift of the engagement elements 16 and thus the can bottom 17**.

Figure 2:
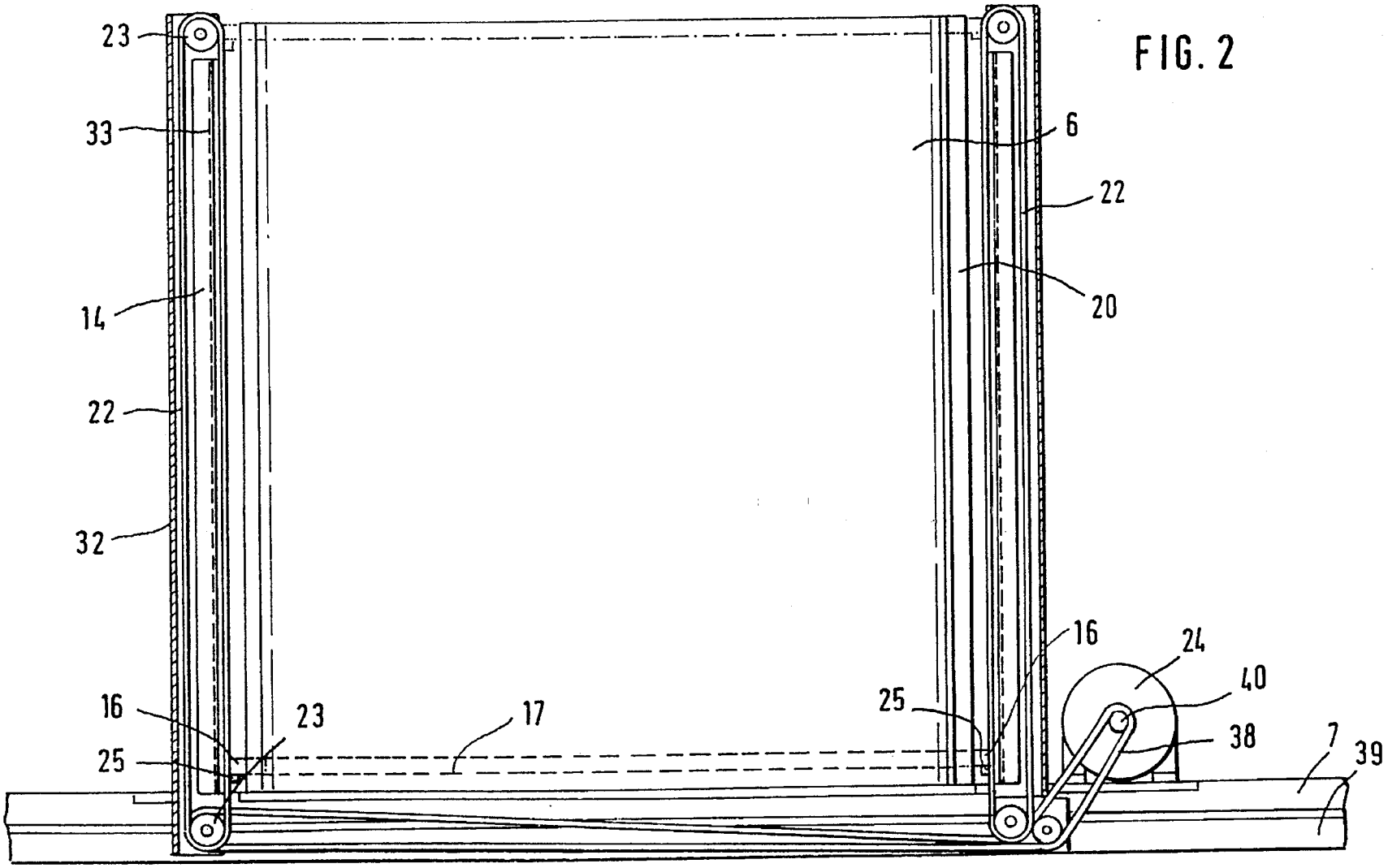
FIG. 2 is a side elevational view of a preferred embodiment of a can bottom-shifting device illustrating a coiler can positioned therein.
Figure 3:
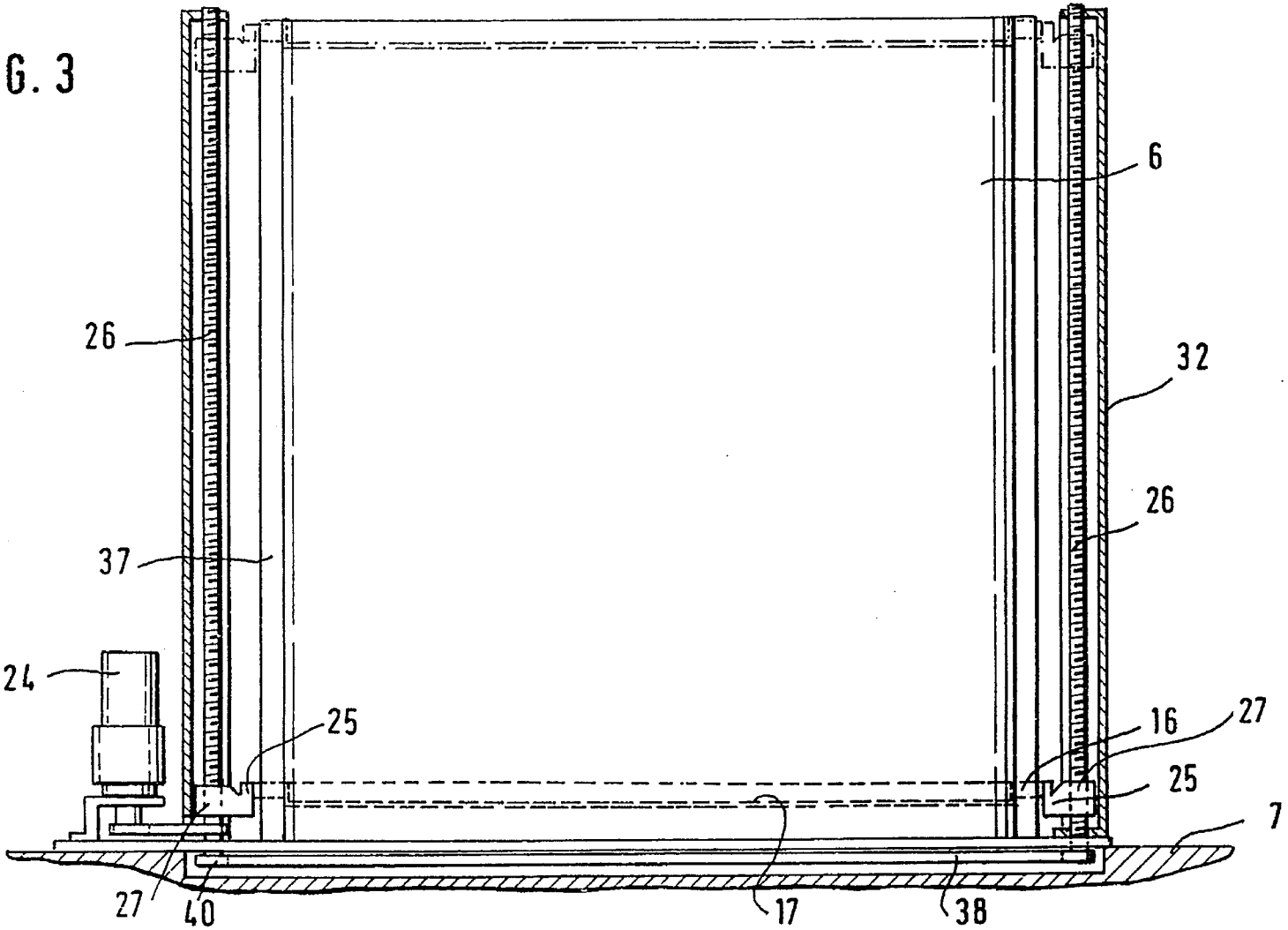
FIG. 3 is a sectional side elevational view of another preferred embodiment of the invention.

Turning to FIG. 3, there is illustrated therein another embodiment of the bottom-shifting device. In this embodiment, instead of the flexible transport elements 22 of the FIG. 2 embodiment, vertically oriented threaded spindles 26 are provided which, upon rotation thereof, cause vertical travel of a respective nut 27 which, by lateral extension, constitutes the carrier element 25. The spindles 26 are rotated by a motor 24 which is coupled to the two spindles 26 by a drive belt and pulley arrangement 38, 40. Dependent upon the direction of rotation of the motor 24, the carrier elements 25 are synchronously and in horizontal alignment raised or lowered and thus move the can bottom 17, by acting on the engagement elements 16.

Figure 4:
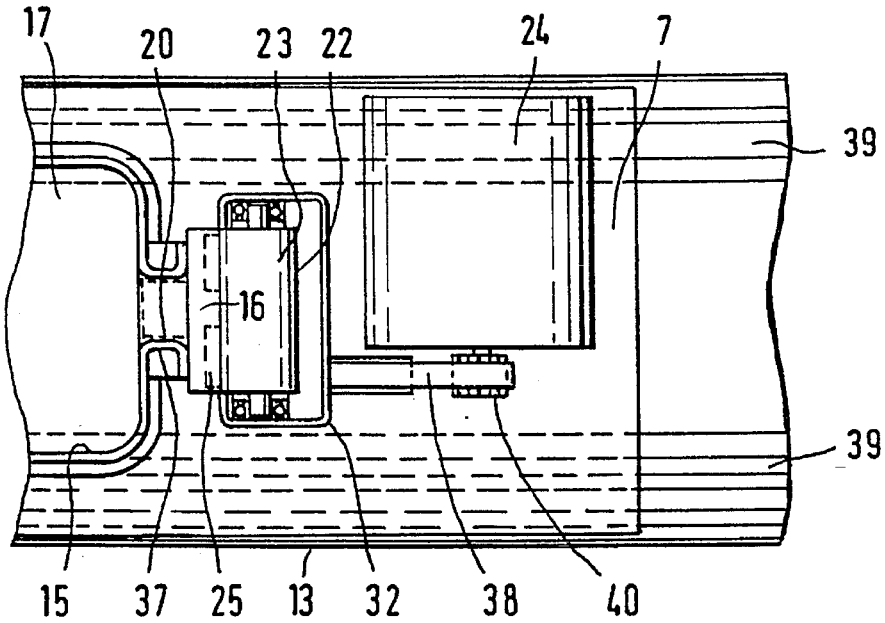
FIG. 4 is a fragmentary top plan view of the construction illustrated in FIG. 2.

FIG. 4 is a partial top plan view of the construction shown in FIG. 2. This Figure shows that the engagement element 16 is situated externally of the can slot 20 and is connected therethrough with the can bottom 17. The engagement element 16 lies on or extends into the respective carrier element 25 mounted on the flexible transporting element 22. The can wall 15 is folded over in the zone of the slot 20 to form a wall reinforcement 37. FIG. 4 shows the upper belt support roller 23 as well as the drive 24, 38, 40. The belt support rollers 23 are themselves supported in the frame 32 which is affixed to the sled 7 which, in turn, is moved back and forth on rails 38 in the direction of arrows A, B as it was noted earlier.

Figure 5:
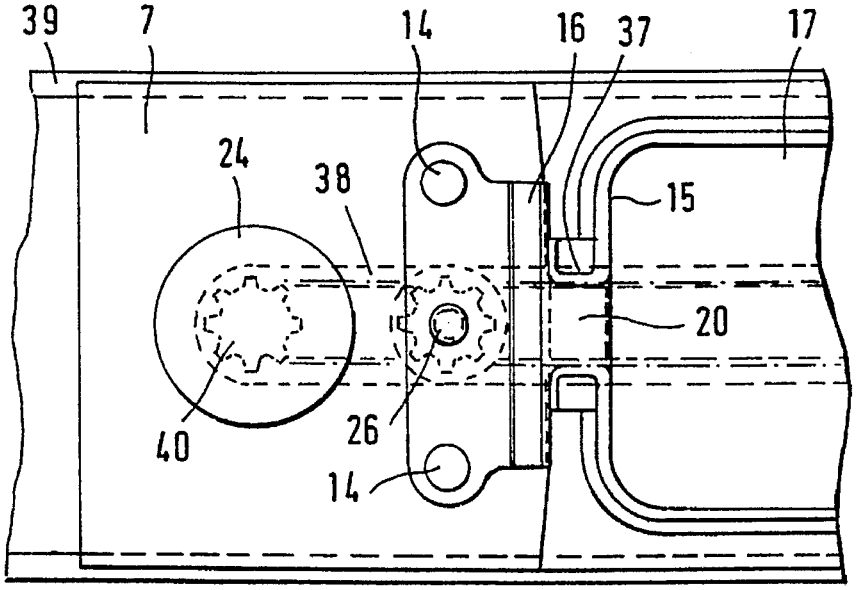
FIG. 5 is fragmentary top plan view of the structure illustrated in FIG. 3.

FIG. 5 is a partial top plan view of the construction shown in FIG. 3. The nut/carrier element unit 25, 27 is guided in vertical guide posts 14 to raise or lower the can bottom 17.

Figure 7:
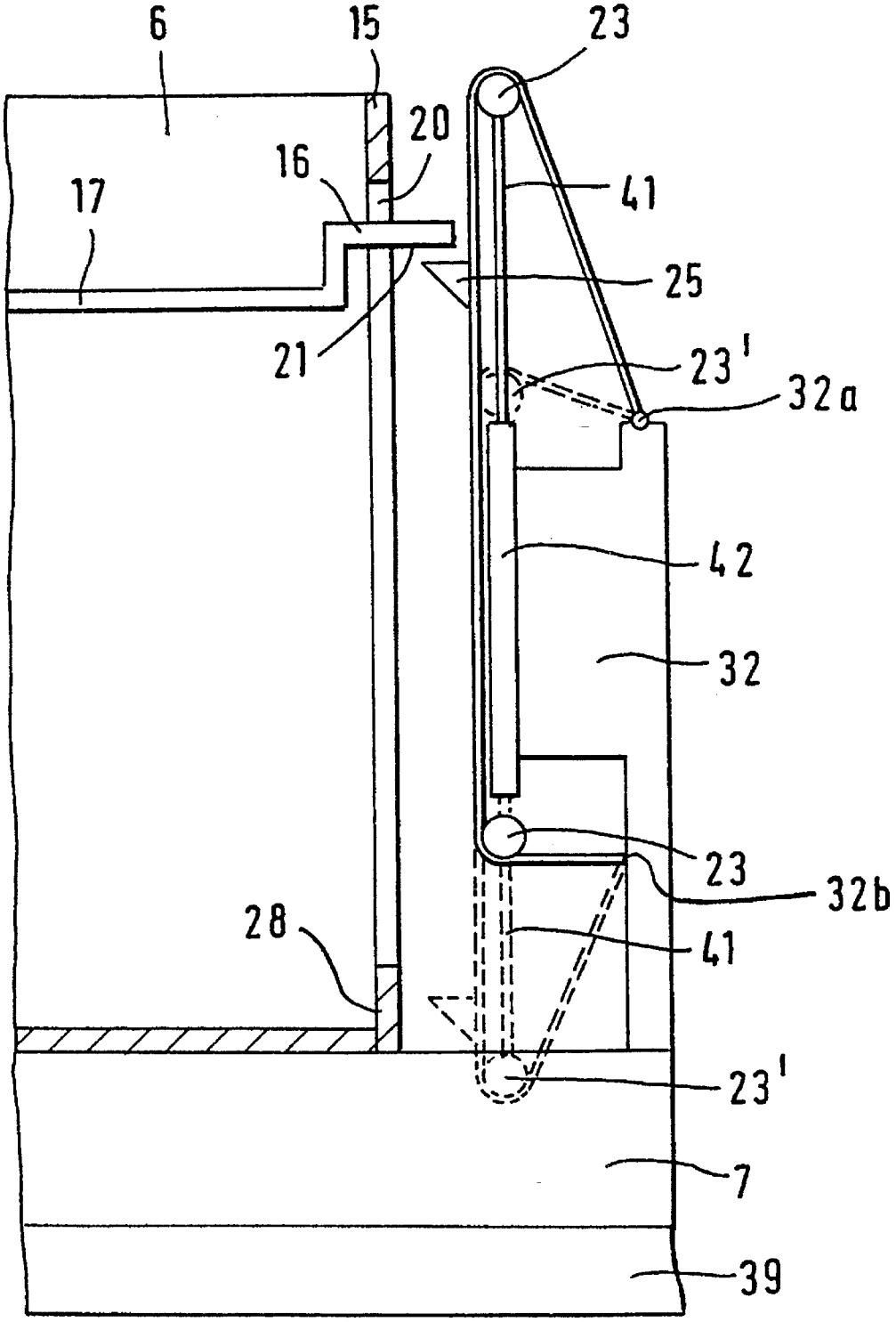
FIG. 7 is a sectional side elevational view of yet another preferred embodiment.

FIG. 7 shows a further embodiment of the invention. In this construction, a double-acting fluid pressure cylinder 42 is supported on the stand 32. The flexible transport element 22 is a belt of definite length; both of its ends are fixedly connected at spaced locations to the stand 32 at locations **32*a* and 32*b* thereof. The flexible transport element 22 is trained about the upper and the lower deflecting rollers 23. In the position depicted in FIG. 7 in solid lines, the piston rod 41 of the fluid pressure cylinder 42 is shortly ahead of its upper dead center, that is, it is almost entirely extended upwardly. The upper and lower deflecting rollers 23 are mounted on opposite ends of the piston rod 41. The carrier element 25 affixed to the flexible transport element 22 is, in the position depicted in FIG. 7, shortly before reaching the upper limit of the can slot 20 provided in opposite narrow walls 28 of the can 6. The underface of the engagement element 16 attached to the can bottom 17 is, for better illustration, shown upwardly spaced from the engagement face of the carrier element 25; it is to be understood that in reality the member 25 is in engagement with the member 16. As the filling of the can progresses, the can bottom 17 is further lowered. When the can is fully charged, the lower deflecting roller 23 reaches the position 23' which, together with the assumed position of the carrier element 25 and the transport element 22** is shown in phantom lines.

Figure 6:
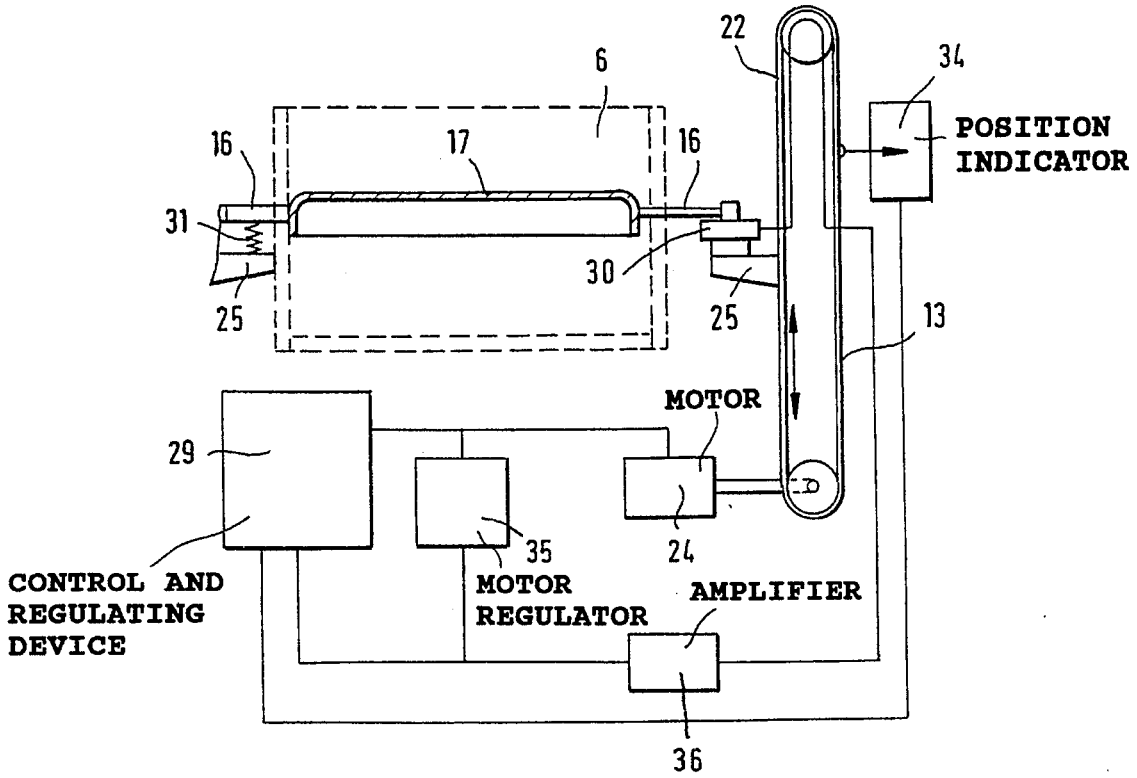
FIG. 6 is a schematic side elevational view of a can bottom-shifting device according to the invention and a block diagram illustrating principles of control.

FIG. 6 shows an overview of the control of the bottom-shifting device according to the invention. On the carrier element 25 a measuring element 30 is positioned on which is supported the engagement element 16 of the can bottom 17. On the opposite side of the can bottom 17, externally of the coiler can 6, the engagement member 16 extending from the can bottom 17 is supported on the carrier element 25 of the other flexible transport element with the interposition of a compensating spring 31. In this manner, the can bottom 17 is maintained at level. The measuring element 30 is, with the intermediary of an amplifier 36, connected with a control and regulating device 29 which controls the flexible transport elements 22 (only one shown in FIG. 6) with the intermediary of a motor regulator 35 and the motor 24. A position indicator 34 is also connected with the control and regulating device 29 for reporting the momentary position of the can as an input magnitude for the control.

In the embodiment according to FIG. 8, two synchronously operating can bottom-shifting devices **13*a* and 13*b* are mounted on the sled 7. On the bottom-shifting devices 13*a*, 13*b* the carrier elements 25*a* and 25*b* are mounted which engage from the below the engagement elements 16*a* and 16*b* projecting out of the can 6 from opposite sides of the can bottom 17. The bar-shaped engagement elements 16*a*, 16*b* are movable in a horizontal direction as indicated by the arrows G and H by means of a non-illustrated driving device comprising gears, pressure cylinders or the like. In FIG. 8***a* the engagement element 16*a* and the carrier element 25*b* are shown in FIG. 8*a* out of engagement with one another. In FIG. 8*a* the carrier element 25*b* is withdrawn to such an extent that the flat can 6 may freely travel in the direction I from the drafting frame and in direction K towards the drafting frame.

Figure 9:
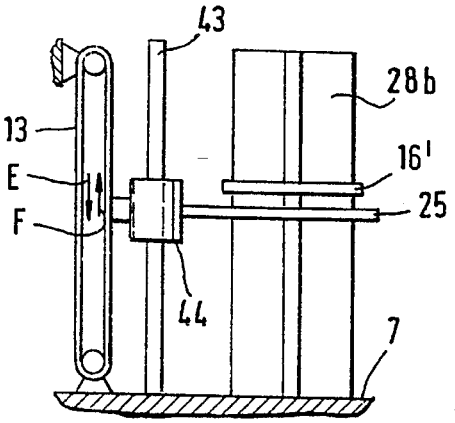
FIG. 9 is a side elevational view of another preferred embodiment.

FIG. 9 shows a round bar 43 which serves as a supporting element and on which a bushing 44 is mounted for vertical travel and to which the carrier element 25 is secured. The engagement element 16 (see FIG. 7) has a transverse head 16' so that a larger and more stable face-to-face engagement with the carrier element 25 is feasible. The bushing 44 is affixed to the bottom-shifting device 13.

Figure 10:
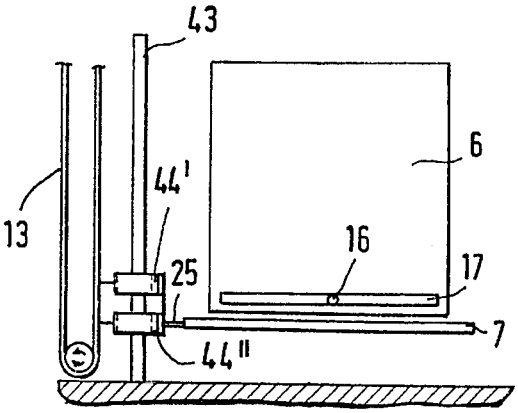
FIG. 10 is a side elevational view of yet another preferred embodiment.

In the variant according to FIG. 10, the angled part of the carrier member 25 engages underneath the transverse head 16'. By virtue of this arrangement the transverse head 16'—together with the can bottom 17—may move far down, providing for great filling height for the sliver.

Figure 11:
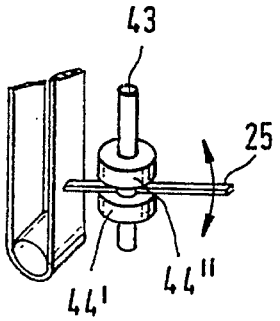
FIG. 11 is a fragmentary perspective view of the embodiment shown in FIG. 10.

As shown in FIG. 11, the bushing is composed of a non-rotatable guide part 44' and a rotatable holding part 44".

Figure 12:
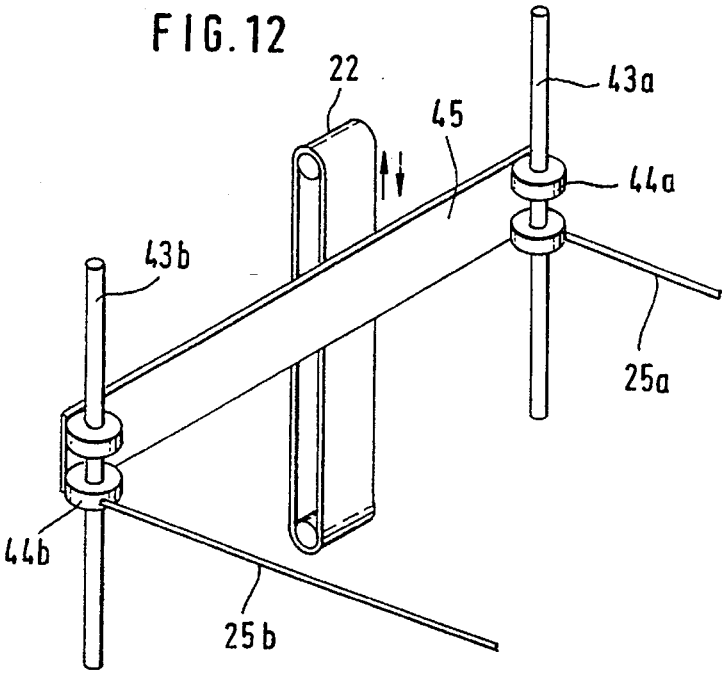
FIGS. 12 and 13 are perspective views of two further preferred embodiments.

In FIG. 12, a can bottom-shifting device 13 is shown in which a transverse transport element 45 is affixed to a flexible transport element 22. Bushings 44*a*, 44*b* are secured to opposite ends of the transverse transport element 45 and vertically slide on guide bars 43*a*, 43*b*. Carrier elements 25*a*, 25*b* are secured to the bushings 44*a*, 44*b* and cooperate with the non-illustrated engagement elements affixed to the can bottom.

Figure 13:
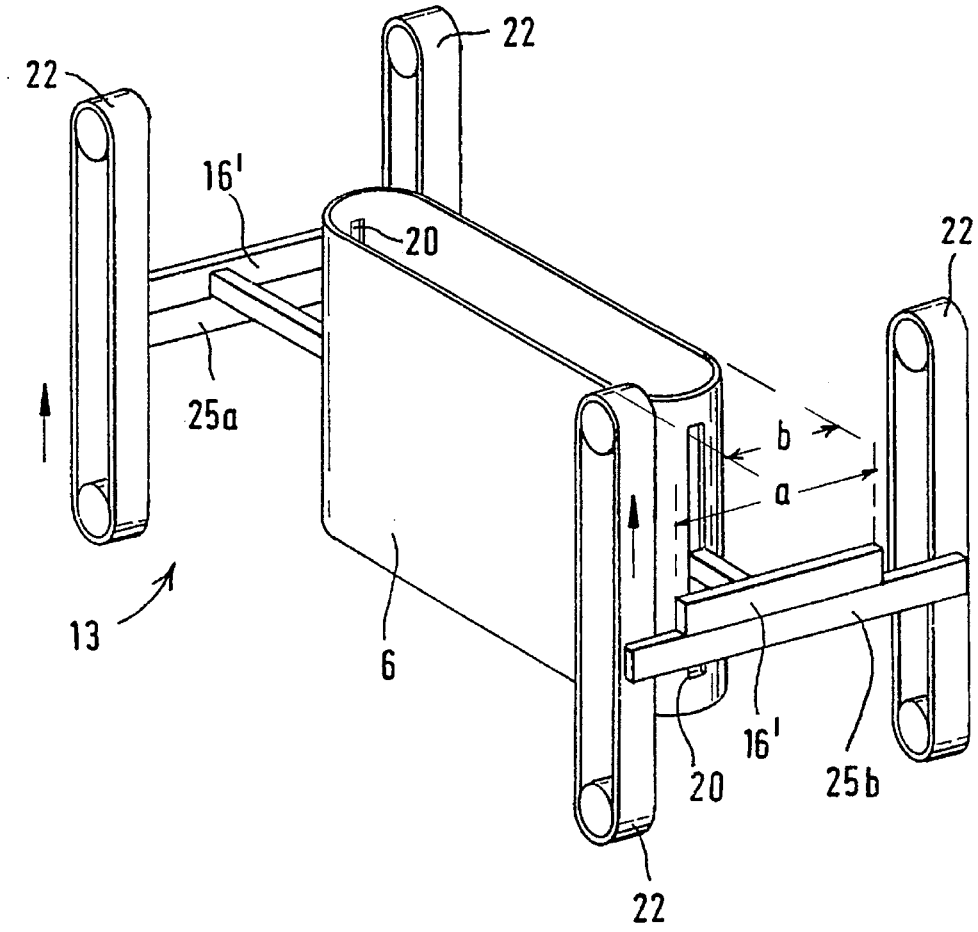
Figure 14:
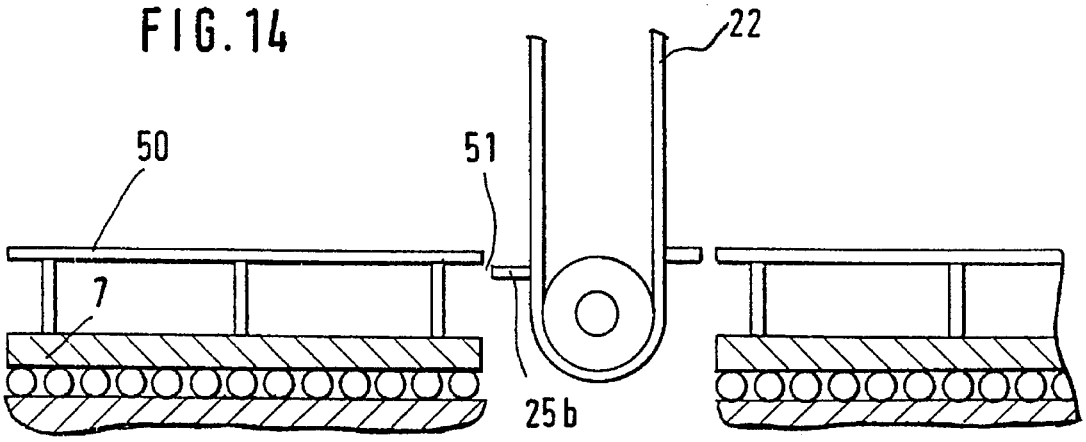
FIG. 14 is a fragmentary sectional side elevational view of the embodiment shown in FIG. 13.

Turning to FIGS. 13 and 14, in the embodiment depicted therein, four flexible transport elements 22 of a can bottom-shifting device 13, are provided and are arranged in pairs. To each pair there is affixed a respective carrier element 25*a*, 25*b* for engaging a respective engagement element 16' affixed to the non-visible bottom of the can 6 and projecting outwardly through the respective can slot 20. Also referring to FIG. 14, on the sled 7 a platform 50 is fixedly mounted on which the flat can 6 may be positioned. The carrier elements 25*a*, 25*b* secured to the respective flexible transport elements 22 (which may be endless toothed belts) pass through an opening 51 underneath the plane of the platform 50 thus permitting the flat can to be shifted without impediment. As may be well observed in FIG. 13, the length a of each engagement element 16' is greater than the width b of the flat coiler can 6 and is thus greater than the width of the elongated can bottom situated within the coiler can 6. The width b is defined as the horizontal distance between the two opposite large walls of the coiler can 6. Further, the lower edge of each engagement element 16' is, along the entire length thereof, in a face-to-face engagement with the respective upper edge of the carrier elements 25*a*, 25*b*. Such a long, face-to-face support on opposite longitudinal ends of the can bottom ensures a stable horizontal guidance of the can bottom in the course of its vertical displacement.

Figure 15:
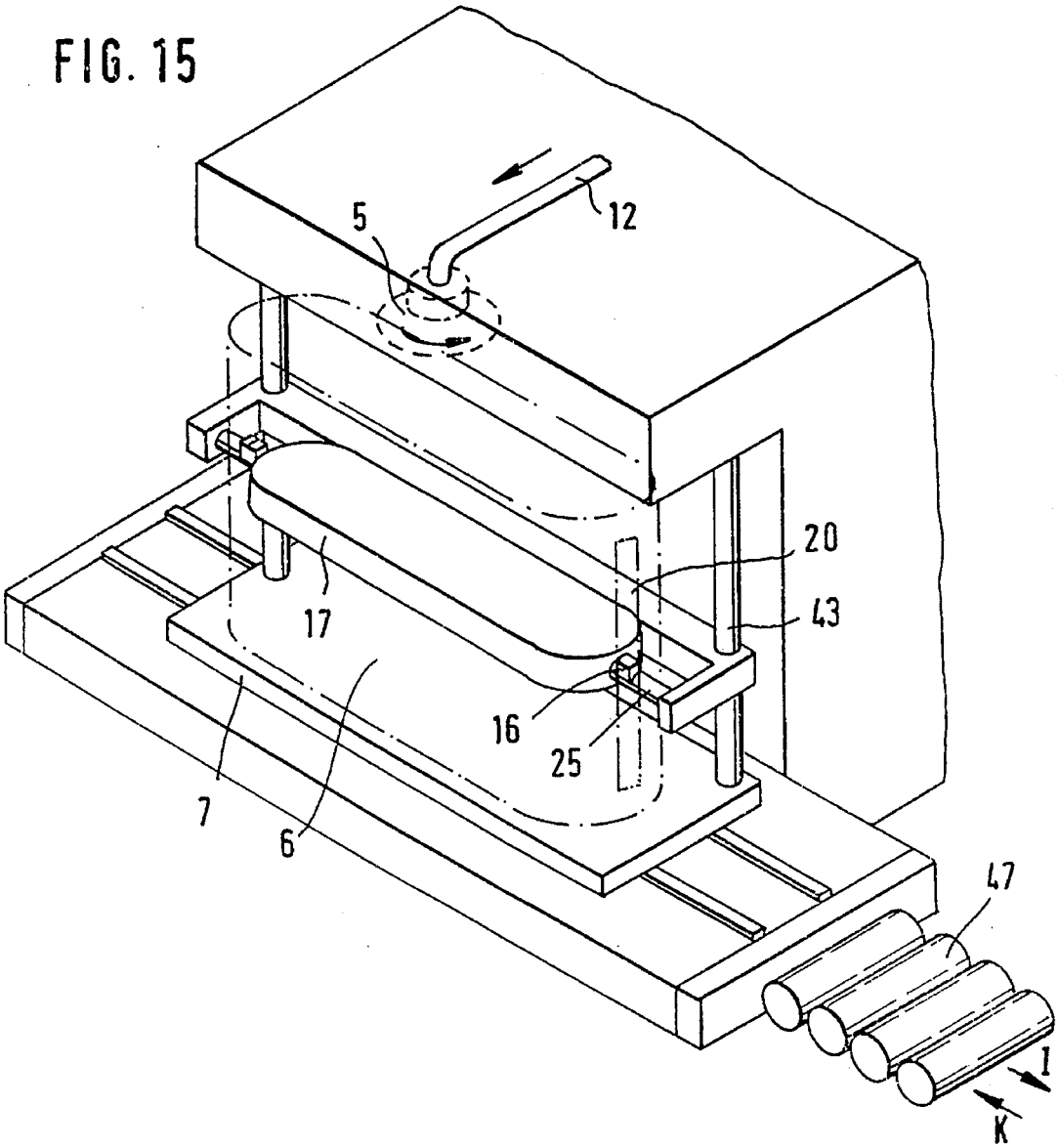
FIG. 15 is a perspective view of still another preferred embodiment.
Figure 16:
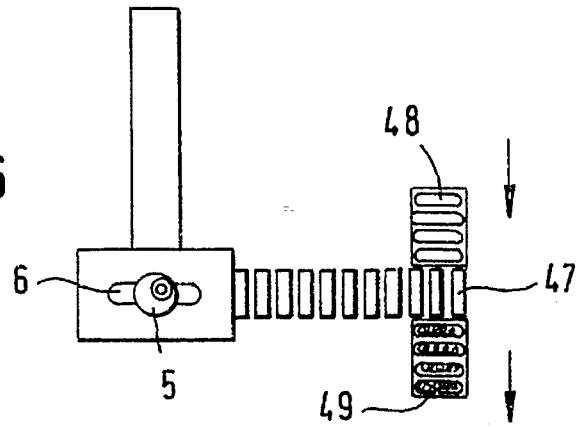
FIG. 16 is a schematic top plan view of the embodiment shown in FIG. 15.

As shown in FIGS. 15 and 16, the flat can 6 in its empty or, respectively, in its full position may be moved parallel to its length dimension on a roller track 47 towards or away from the coiler head 5 in the directions I or K to or from a can storage device 49. In this embodiment the empty-can storage device 48 and the full-can storage device 49 are on the same side of the sliver producing machine (drafting frame). The invention also encompasses an embodiment in which a further (non-illustrated) supply or removal device for the flat cans is provided. In such a case the empty-can storage device and the full-can storage device are situated on opposite sides of the sliver producing machine.

It is a further advantage of the invention that by virtue of the fact that the carrier elements of the bottom-shifting device may be moved away, the flat cans may freely move into and out of the charging station of the sliver-producing machine. Further, by lowering the carrier elements below the level of the lower edge of the can bottom (or the upper edge of the can-supporting carriage), the can bottom may be lowered to a great extent to thus provide for a large can volume available to receive sliver.

The invention also encompasses an embodiment in which the can bottom-shifting device is mounted on the plant floor rather than on a sled. In such an embodiment a device has to be provided for the intermediate conveyance of the flat can.

It will be understood that the above description of the present invention is susceptible to various modifications, changes and adaptations, and the same are intended to be comprehended within the meaning and range of equivalents of the appended claims.

What is claimed is:

1. A system for handling sliver produced by a fiber processing machine, comprising (a) a sliver coiler head forming part of the fiber processing machine;

(b) a flat coiler can supported in a substantially upright position under the coiler head for receiving sliver therefrom; the coiler can having (1) a vertical wall composed of two opposite large wall portions and two opposite small wall portions;

(2) a vertical slot being provided in said small wall portions;

(3) an elongated can bottom surrounded by the vertical wall and being vertically displaceable relative to the wall; and (4) opposite engagement elements affixed to said can bottom and projecting through said vertical slots; and (c) a can bottom shifting apparatus disposed externally of the coiler can and facing said vertical wall; the can bottom shifting apparatus having (1) carrier elements for engaging respective said engagement elements of said can bottom to vertically shift said can bottom;

(2) vertically oriented, rotatably supported threaded spindles; said carrier elements being threadedly mounted on respective said spindles; said spindles and said carrier elements threaded thereto forming stabilizing means for positively maintaining an orientation of said can bottom during vertical shifting thereof by said can bottom shifting apparatus; and (3) drive means for rotating said spindles for effecting a vertical travel of said carrier elements on said spindles.

2. A system for handling sliver produced by a fiber processing machine, comprising (a) a sliver coiler head forming part of the fiber processing machine;

(b) a flat coiler can supported in a substantially upright position under the coiler head for receiving sliver therefrom; the coiler can having (1) a vertical wall composed of two opposite large wall portions and two opposite small wall portions;

(2) a vertical slot being provided in said small wall portions;

(3) an elongated can bottom surrounded by the vertical wall and being vertically displaceable relative to the wall; said can bottom having a width measured parallel to the distance between said large wall portions; and (4) opposite engagement elements affixed to said can bottom and projecting through said vertical slots; each said engagement element extending from said can bottom through a respective said vertical slot and each engagement element having an external portion extending externally of said vertical wall; each said external portion being oriented parallel to the can bottom width and having a length greater than said can bottom width; each said external portion having an edge face being in a face-to-face engagement with a respective said carrier element along a distance greater than said can bottom width; said engagement elements and said carrier elements together constituting stabilizing means for positively maintaining an orientation of said can bottom during vertical shifting thereof by said can bottom shifting apparatus; and (c) a can bottom shifting apparatus disposed externally of the coiler can and facing said vertical wall; the can bottom shifting apparatus having carrier elements for engaging respective said engagement elements of said can bottom to vertically shift said can bottom.

3. The system as defined in claim 2, wherein each said carrier element comprises an elongated bar having opposite ends; further wherein said can bottom shifting apparatus comprises two pairs of vertically-oriented transport elements; one of said carrier elements being attached at opposite ends thereof to the transport elements of one of said pairs and another of said carrier elements being attached at opposite ends thereof to the transport elements of another of said pairs; each said carrier element having an edge face for establishing said face-to-face engagement with respective said engagement elements.

* * * * *